US011994352B2

(12) United States Patent
Naoi et al.

(10) Patent No.: US 11,994,352 B2
(45) Date of Patent: May 28, 2024

(54) HEAT EXCHANGER

(71) Applicant: DAIKIN INDUSTRIES, LTD., Osaka (JP)

(72) Inventors: Takehiro Naoi, Osaka (JP); Taichi Koshiji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/222,599

(22) Filed: Jul. 17, 2023

(65) Prior Publication Data

US 2023/0400265 A1 Dec. 14, 2023

Related U.S. Application Data

(63) Continuation of application No. PCT/JP2022/002237, filed on Jan. 21, 2022.

(30) Foreign Application Priority Data

Jan. 22, 2021 (JP) ..... 2021-008709

(51) Int. Cl.
*F28F 9/02* (2006.01)

(52) U.S. Cl.
CPC ..... *F28F 9/0275* (2013.01); *F28F 2210/10* (2013.01)

(58) Field of Classification Search
CPC ..... F28F 9/0275; F28F 2210/10; F28F 9/22; F28F 9/26; F28D 1/047
(Continued)

(56) References Cited

U.S. PATENT DOCUMENTS 5,417,279 A * 5/1995 Wada ..... F24F 1/0067 165/145
5,896,921 A * 4/1999 Lee ..... F28D 1/0477 165/145

(Continued)

FOREIGN PATENT DOCUMENTS

JP H01234689 A 9/1989
JP H01305276 A 12/1989

(Continued)

OTHER PUBLICATIONS

International Search Report issued in corresponding International Application No. PCT/JP2022/002237, dated Mar. 1, 2022, with translation (6 pages).

(Continued)

*Primary Examiner* — Jon T. Schermerhorn, Jr.
(74) *Attorney, Agent, or Firm* — Osha Bergman Watanabe & Burton LLP

(57) ABSTRACT

A heat exchanger includes: a first heat transfer tube; a second heat transfer tube; and a branching tube having a first end connected to an end of the first heat transfer tube, a second end connected to an end of the second heat transfer tube, and a third end, and connecting the first end, the second end, and the third end to each other. The first heat transfer tube is larger in heat exchange quantity than the second heat transfer tube. The branching tube has a first flow path connecting the first end with the third end, and a second flow path connecting the second end with the third end. The first flow path is shorter than the second flow path. The branching tube includes: a U portion; and an inflow portion having an end connected to the U portion.

4 Claims, 6 Drawing Sheets

(58) Field of Classification Search
USPC ..... 165/145
See application file for complete search history.

(56) References Cited

U.S. PATENT DOCUMENTS

| | | | | |
|---|---|---|---|---|
| 6,142,220 | A * | 11/2000 | Motegi | F28F 9/0275 165/110 |
| 6,363,967 | B1 * | 4/2002 | Tanaka | F24F 1/0067 137/561 A |
| 7,703,504 | B2 * | 4/2010 | Ishibashi | F28D 1/0477 29/890.035 |
| 2008/0282725 | A1 | 11/2008 | Ishibashi et al. | |
| 2015/0362222 | A1 * | 12/2015 | Matsuda | F25B 41/42 165/174 |

FOREIGN PATENT DOCUMENTS

| | | | |
|---|---|---|---|
| JP | H06194003 | A | 7/1994 |
| JP | H07004882 | A | 1/1995 |
| JP | 2006097987 | A | 4/2006 |
| JP | 2007046804 | A | 2/2007 |
| JP | 2019132511 | A | 8/2019 |
| WO | 2014115240 | A1 | 7/2014 |
| WO | 2015111220 | A1 | 7/2015 |

OTHER PUBLICATIONS

Written Opinion issued in corresponding International Application No. PCT/JP2022/002237, dated Mar. 1, 2022 (5 pages).

Notice of Reasons for Refusal issued in corresponding Japanese Patent Application No. 2021-008709, dated Feb. 22, 2022, with translation (10 pages).

Decision to Grant issued in corresponding Japanese Patent Application No. 2021-008709, dated Aug. 2, 2022, with translation (5 pages).

English translation of an International Preliminary Report on Patentability and Written Opinion issued in corresponding International Application No. PCT/JP2022/002237, dated Aug. 3, 2023 (7 pages).

* cited by examiner

HEAT EXCHANGER

CROSS-REFERENCE TO RELATED APPLICATIONS

This is a continuation application of International Patent Application No. PCT/JP2022/002237, filed Jan. 21, 2022, and claims priority to Japanese Patent Application No. 2021-008709, filed Jan. 22, 2021. The contents of these priority applications are incorporated herein by reference.

TECHNICAL FIELD

The present disclosure relates to a heat exchanger.

BACKGROUND

There has been known a heat exchanger constituting a refrigerant circuit of an air conditioner.

Patent Literature 1 (Japanese Unexamined Patent Publication No. H1-305276) discloses a heat exchanger including a plurality of pipes (heat transfer tubes) and a branching pipe connected to the pipes. In the heat exchanger according to Patent Literature 1, the plurality of pipes is aligned to the windward and to the leeward of wind generated by a fan. The branching pipe includes a single inlet pipe and two branch ports, and allows a refrigerant flowing in via the inlet pipe to flow to the windward pipe and the leeward pipe via the two branch ports.

In the heat exchanger according to Patent Literature 1, the two branch ports of the branching pipe are provided with orifices different from each other in flow path diameter, to have a difference in flow rate of an incoming refrigerant between the windward pipe and the leeward pipe. The heat exchanger according to Patent Literature 1 can accordingly suppress a difference in degree of superheating generated in the windward pipe and the leeward pipe, and inhibit deterioration in performance of the heat exchanger.

SUMMARY

A heat exchanger includes a first heat transfer tube, a second heat transfer tube, and a branching tube. The branching tube has a first end connected to an end of the first heat transfer tube, a second end connected to an end of the second heat transfer tube, and a third end. The branching tube connects the first end, the second end, and the third end to each other. The first heat transfer tube is larger in heat exchange quantity than the second heat transfer tube. The branching tube includes a first flow path connecting the first end and the third end, and a second flow path connecting the second end and the third end, and the first flow path is shorter than the second flow path. The branching tube includes a U portion, and an inflow portion having an end connected to the U portion. The U portion includes a bent portion, a first linear portion, and a second linear portion. The bent portion is bent to have a predetermined radius. The first linear portion extends linearly from an end of the bent portion. The second linear portion extends linearly from the other end of the bent portion. The first linear portion has an end far from the bent portion, and the end corresponds to the first end. The second linear portion has an end far from the bent portion, and the end corresponds to the second end. The inflow portion has the end connected to the first linear portion, and the other second end corresponding to the third end. The first flow path includes the inflow portion and part of the first linear portion. The second flow path includes the inflow portion, part of the bent portion, and the second linear portion.

DETAILED DESCRIPTION

A heat exchanger according to the present disclosure is exemplarily applied as a heat exchanger of a refrigeration cycle apparatus configured to achieve a vapor compression refrigeration cycle, though not limited in terms of its use. Described herein with reference to the drawings is a case where the heat exchanger according to the present disclosure is applied as a heat source heat exchanger 11 of an air conditioner 1 exemplifying the refrigeration cycle apparatus. The air conditioner merely exemplifies the refrigeration cycle apparatus. The heat exchanger according to the present disclosure may be applied to a different refrigeration cycle apparatus such as a refrigerator, a freezer, a hot water supplier, or a floor heater.

Description is hereinafter made initially to the air conditioner 1 including the heat source heat exchanger 11. Described thereafter are details of the heat source heat exchanger 11.

(1) Configuration of Air Conditioner

Figure 1:
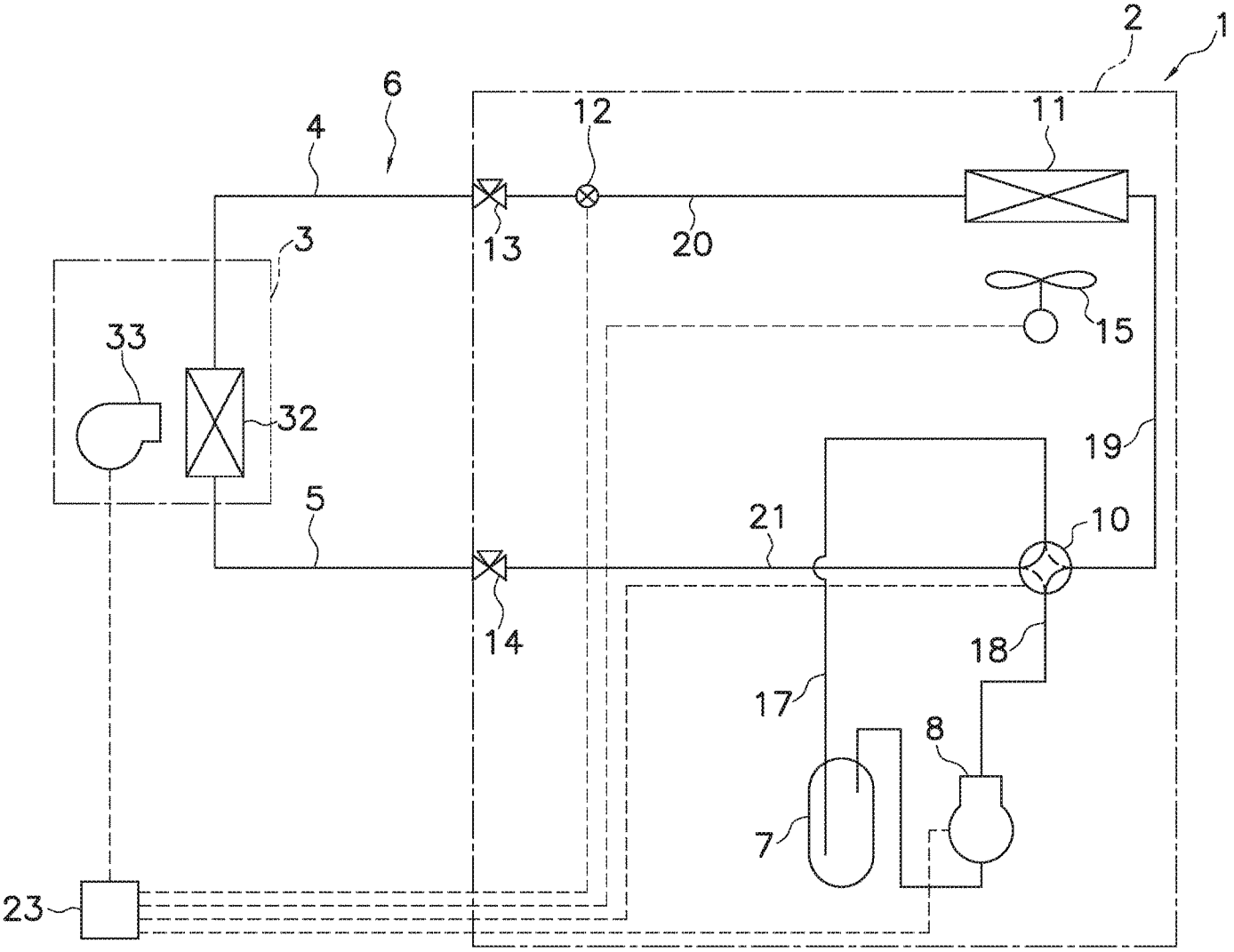
FIG. 1 is a schematic configuration diagram of an air conditioner 1.

The air conditioner 1 will be described with reference to the drawings. FIG. 1 is a schematic configuration diagram of the air conditioner 1 including, as the heat source heat exchanger 11, a heat exchanger according to one or more embodiments of the present disclosure.

The air conditioner 1 is configured to achieve the vapor compression refrigeration cycle to cool and heat an air conditioning target space. Examples of the air conditioning target space include a space in a building such as an office building, a commercial facility, or a residence.

As depicted in FIG. 1, the air conditioner 1 principally includes a heat source unit 2, a utilization unit 3, a liquid-refrigerant connection pipe 4, a gas-refrigerant connection pipe 5, and a control unit 23 configured to control devices constituting the heat source unit 2 and the utilization unit 3. The liquid-refrigerant connection pipe 4 and the gas-refrigerant connection pipe 5 are refrigerant connection pipes connecting the heat source unit 2 and the utilization unit 3. In the air conditioner 1, the heat source unit 2 and the utilization unit 3 are connected via the refrigerant connection pipes 4 and 5 to constitute a refrigerant circuit 6.

The air conditioner 1 depicted in FIG. 1 includes the single utilization unit 3. The air conditioner 1 may alternatively include a plurality of utilization units 3 connected parallelly to the heat source unit 2 by the refrigerant connection pipes 4 and 5. The air conditioner 1 may still alternatively include a plurality of heat source units 2. Furthermore, the air conditioner 1 may be of an integral type including the heat source unit 2 and the utilization unit 3 that are formed integrally with each other.

As depicted in FIG. 1, the heat source unit 2 principally includes an accumulator 7, a compressor 8, a flow direction switching mechanism 10, the heat source heat exchanger 11, an expansion mechanism 12, a liquid-side shutoff valve 13, a gas-side shutoff valve 14, and a heat source fan 15. As depicted in FIG. 1, the utilization unit 3 principally includes a utilization heat exchanger 32 and a utilization fan 33.

The air conditioner 1 will be described in terms of its behavior.

During cooling operation, the control unit 23 controls behavior of the flow direction switching mechanism 10 to switch the refrigerant circuit 6 into a state where the heat source heat exchanger 11 functions as a refrigerant radiator (condenser) and the utilization heat exchanger 32 functions as a refrigerant evaporator. Specifically, the control unit 23 controls behavior of the flow direction switching mechanism 10 to cause a suction tube 17 connected to a suction side of the compressor 8 to communicate with a second gas refrigerant tube 21 connecting the flow direction switching mechanism 10 and the gas-side shutoff valve 14. Furthermore, the control unit 23 controls behavior of the flow direction switching mechanism 10 to cause a discharge tube 18 connected to a discharge side of the compressor 8 to communicate with a first gas refrigerant tube 19 connecting the flow direction switching mechanism 10 and a gas side of the heat source heat exchanger 11 (see solid lines in the flow direction switching mechanism 10 in FIG. 1). During cooling operation, the control unit 23 operates the compressor 8, the heat source fan 15, and the utilization fan 33. During cooling operation, the control unit 23 adjusts, in accordance with measurement values and the like of various sensors, the compressor 8, the number of revolutions of a motor of each of the heat source fan 15 and the utilization fan 33, and an electronic expansion valve exemplifying the expansion mechanism 12 to have a predetermined opening degree.

When the control unit 23 controls behavior of various devices in the air conditioner 1, a low-pressure gas refrigerant in the refrigeration cycle is sucked into the compressor 8, is compressed to have high pressure in the refrigeration cycle, and is then discharged from the compressor 8. The high-pressure gas refrigerant discharged from the compressor 8 is sent to the heat source heat exchanger 11 via the flow direction switching mechanism 10. The high-pressure gas refrigerant sent to the heat source heat exchanger 11 exchanges heat with air serving as a cooling source supplied by the heat source fan 15 in the heat source heat exchanger 11 functioning as a refrigerant radiator, to radiate heat and come into a high-pressure liquid refrigerant. The high-pressure liquid refrigerant obtained by radiating heat in the heat source heat exchanger 11 is sent to the expansion mechanism 12 via a liquid refrigerant tube 20. In the expansion mechanism 12, the high-pressure liquid refrigerant is decompressed to come into a low-pressure refrigerant in a gas-liquid two-phase state. The low-pressure refrigerant in the gas-liquid two-phase state obtained by decompression in the expansion mechanism 12 is sent to the utilization heat exchanger 32 via the liquid refrigerant tube 20, the liquid-side shutoff valve 13, and the liquid-refrigerant connection pipe 4. The low-pressure refrigerant in the gas-liquid two-phase state sent to the utilization heat exchanger 32 exchanges heat to be evaporated, with air supplied into the air conditioning target space by the utilization fan 33 in the utilization heat exchanger 32 functioning as a refrigerant evaporator. In this case, air cooled through heat exchange with the refrigerant is supplied into the air conditioning target space to cool the air conditioning target space. A low-pressure gas refrigerant obtained by evaporation in the utilization heat exchanger 32 is sucked into the compressor 8 again via the gas-refrigerant connection pipe 5, the gas-side shutoff valve 14, the flow direction switching mechanism 10, and the accumulator 7.

During heating operation, the control unit 23 controls behavior of the flow direction switching mechanism 10 to switch the refrigerant circuit 6 into a state where the heat source heat exchanger 11 functions as a refrigerant evaporator and the utilization heat exchanger 32 functions as a refrigerant radiator (condenser). Specifically, the control unit 23 controls behavior of the flow direction switching mechanism 10 to cause the suction tube 17 to communicate with the first gas refrigerant tube 19 and cause the discharge tube 18 to communicate with the second gas refrigerant tube 21 (see broken lines in the flow direction switching mechanism 10 in FIG. 1). During heating operation, the control unit 23 operates the compressor 8, the heat source fan 15, and the utilization fan 33. During heating operation, the control unit 23 adjusts, in accordance with measurement values and the like of various sensors, the compressor 8, the number of revolutions of the motor of each of the heat source fan 15 and the utilization fan 33, and the electronic expansion valve exemplifying the expansion mechanism 12 to have a predetermined opening degree.

When the control unit 23 controls behavior of various devices in the air conditioner 1 in this manner, the low-pressure gas refrigerant in the refrigeration cycle is sucked into the compressor 8, is compressed to have high pressure in the refrigeration cycle, and is then discharged from the compressor 8. The high-pressure gas refrigerant discharged from the compressor 8 is sent to the utilization heat exchanger 32 via the flow direction switching mechanism 10, the gas-side shutoff valve 14, and the gas-refrigerant connection pipe 5. The high-pressure gas refrigerant sent to the utilization heat exchanger 32 exchanges heat with air supplied into the air conditioning target space by the utilization fan 33 in the utilization heat exchanger 32 functioning as a refrigerant radiator (condenser) to radiate heat and come into a high-pressure liquid refrigerant. In this case, air heated through heat exchange with the refrigerant is supplied into the air conditioning target space to heat the air conditioning target space. The high-pressure liquid refrigerant obtained by radiating heat in the utilization heat exchanger 32 is sent to the expansion mechanism 12 via the liquid-refrigerant connection pipe 4, the liquid-side shutoff valve 13, and the liquid refrigerant tube 20. The refrigerant sent to the expansion mechanism 12 is decompressed by the expansion mechanism 12 to come into a low-pressure refrigerant in the gas-liquid two-phase state. The low-pressure refrigerant in the gas-liquid two-phase state obtained by decompression in the expansion mechanism 12 is sent to the heat source heat exchanger 11 via the liquid refrigerant tube 20. The low-pressure refrigerant in the gas-liquid two-phase state sent to the heat source heat exchanger 11 exchanges heat with air serving as a heating source supplied by the heat source fan 15 in the heat source heat exchanger 11 functioning as a refrigerant evaporator to be evaporated and come into a low-pressure gas refrigerant. The low-pressure refrigerant obtained by evaporation in the heat source heat exchanger 11 is sucked into the compressor 8 again via the flow direction switching mechanism 10 and the accumulator 7.

(2) Configuration of Heat Source Unit

The heat source unit 2 will be described next in terms of its shape, structure, and the like.

Figure 2:
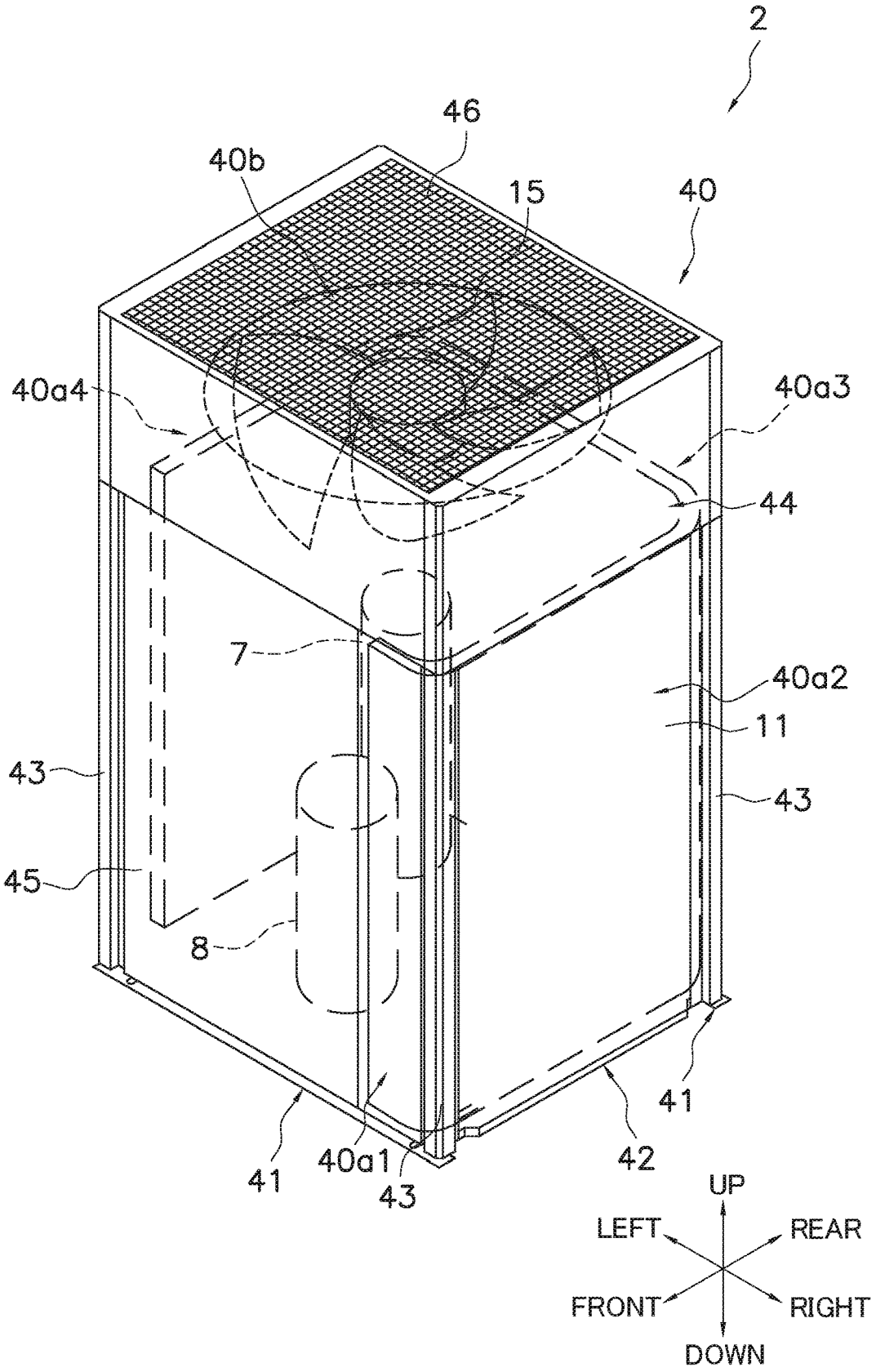
FIG. 2 is a schematic external perspective view of a heat source unit 2.
Figure 3:
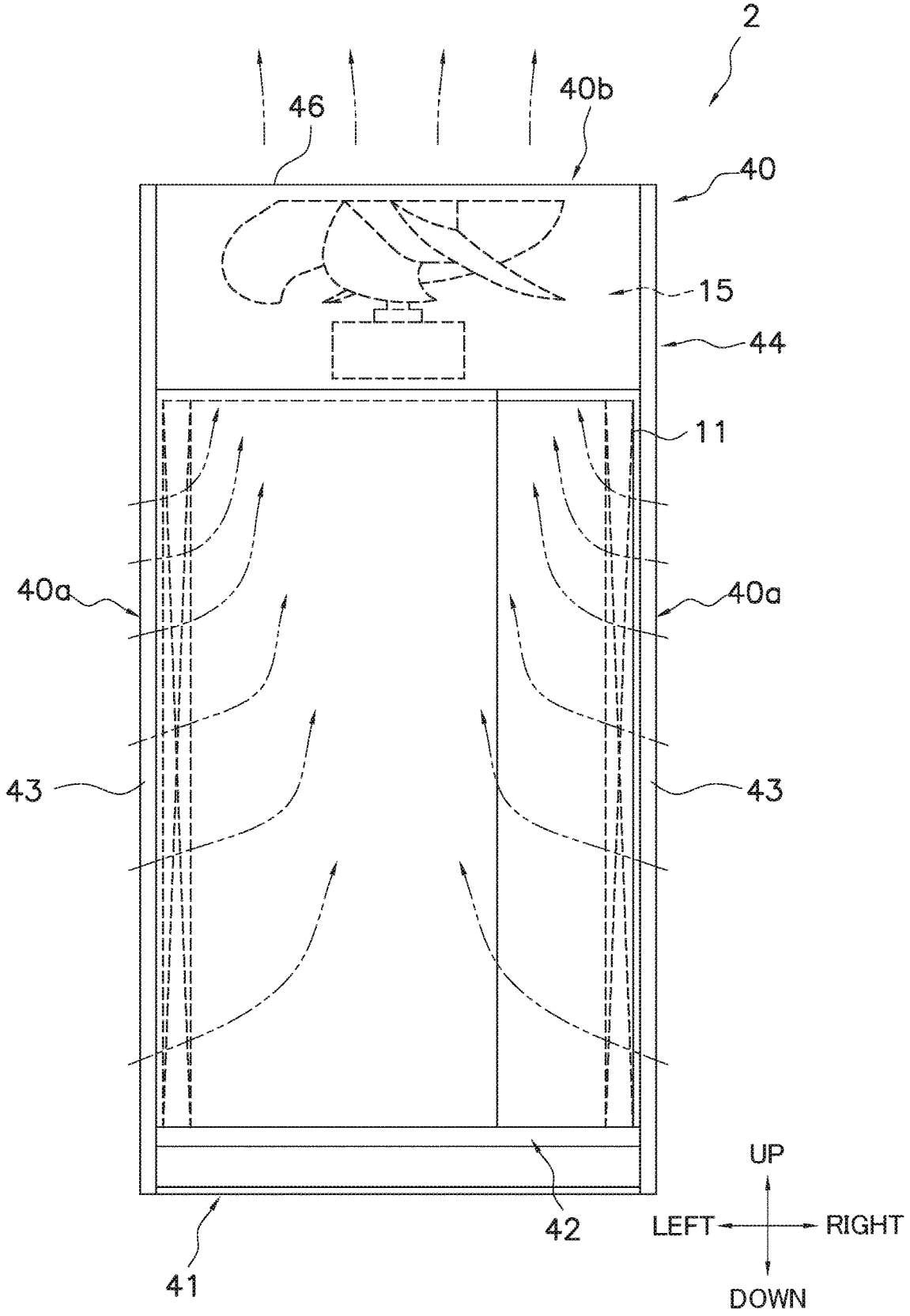
FIG. 3 is a schematic front view of the heat source unit 2.
Figure 4:
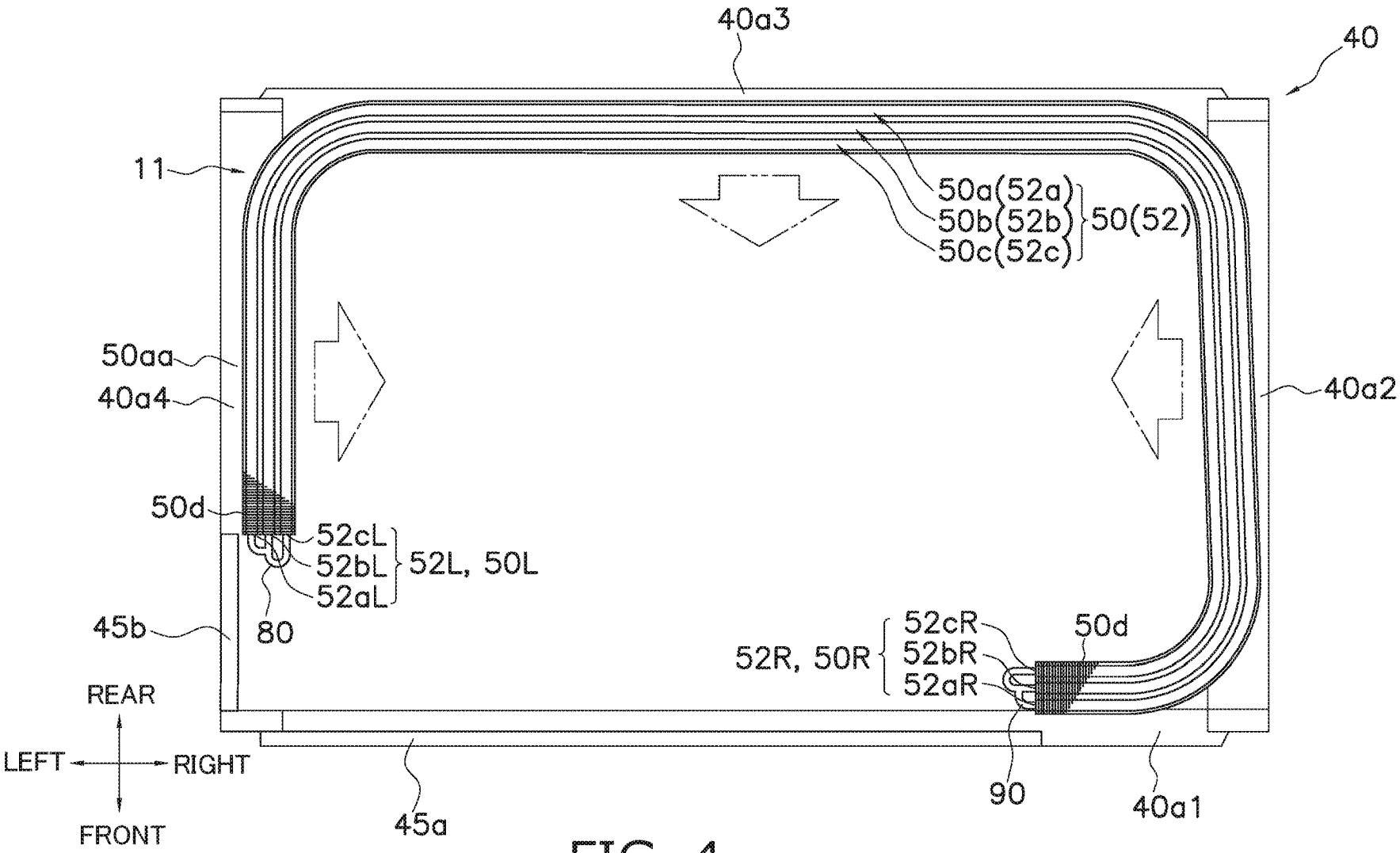
FIG. 4 is a schematic plan view of the heat source unit 2.

FIG. 2 is a schematic external perspective view of the heat source unit 2. FIG. 3 is a schematic front view of the heat source unit 2 (excluding refrigerant circuit constituent components other than the heat source heat exchanger 11). FIG. 4 is a schematic plan view of the heat source unit 2 (excluding a fan module 44 to be described later and the refrigerant circuit constituent components other than the heat source heat exchanger 11).

The following description may include expressions such as "up", "down", "left", "right", "front", "rear", "front surface", and "rear surface" to indicate directions and positional relationships. The directions indicated by these expressions follow directions of arrows in the drawings unless otherwise specified.

The heat source unit 2 is a heat exchange unit of an upward blow type configured to suck air via a side surface of a casing 40 and send out air via a top surface of the casing 40.

The heat source unit 2 principally includes the casing 40 having a substantially rectangular parallelepiped box shape, and the refrigerant circuit constituent components constituting part of the refrigerant circuit 6. The refrigerant circuit constituent components include the accumulator 7, the compressor 8, the heat source heat exchanger 11, the flow direction switching mechanism 10, the expansion mechanism 12, the liquid-side shutoff valve 13, the gas-side shutoff valve 14, and the like. The heat source fan 15 and the refrigerant circuit constituent components are accommodated in the casing 40.

(2-1) Casing

The casing 40 principally includes a pair of installation legs 41 extending transversely, a bottom frame 42 spanning the pair of installation legs 41, a pillar 43, the fan module 44, and a side panel 45. The pillar 43 extends vertically from a corner of the bottom frame 42. The fan module 44 is attached to an upper end of the pillar 43. The side panel 45 is a plate-shaped member. The side panel 45 is disposed to cover a front surface and a front-side portion of a left side surface of the heat source unit 2.

The bottom frame 42 constitutes a bottom surface of the casing 40. The bottom frame 42 is provided thereon with the heat source heat exchanger 11, the compressor 8, the accumulator 7, and the like.

The side panel 45 is a plate-shaped member extending vertically from the bottom frame 42 to the fan module 44. The side panel 45 is approximately positioned not to face a heat exchange unit 50 to be described later, of the heat source heat exchanger 11. The side panel 45 includes a front panel 45*a* disposed to the front surface and a left side panel 45*b* disposed to the left side surface.

The front panel 45*a* extends transversely from a position adjacent to a right end 50R of the heat exchange unit 50 to be described later to a left front corner of the heat source unit 2.

The left side panel 45*b* extends anteroposteriorly from the left front corner of the heat source unit 2 to a position adjacent to a left end 50L of the heat exchange unit 50.

The fan module 44 is disposed above the heat source heat exchanger 11 (on the casing 40). The fan module 44 is an aggregate including a substantially rectangular parallelepiped box having opened upper and lower faces and the heat source fan 15 accommodated in the box. The fan module 44 has a top opening serving as an air blow-out port 40*b* of the casing 40. The air blow-out port 40*b* is provided with a blow-out grill 46. The heat source fan 15 is disposed to face the air blow-out port 40*b* in the casing 40. As indicated by arrows in FIG. 3 and FIG. 4, the heat source fan 15 imports air into the casing 40 via an air intake port 40*a* in the side surface of the casing 40 and discharges air via the air blow-out port 40*b*.

The air intake port 40*a* is provided in the side surface (in this case, each of a front surface, a rear surface, and right and left side surfaces) of the casing 40, and the air blow-out port 40*b* is provided in the top surface. As indicated by the arrows in FIG. 3 and FIG. 4, air having passed the air intake port 40*a* is imported from outside to inside the casing 40 by an air flow generated by the heat source fan 15 accommodated in the fan module 44. The air intake ports 40*a* include an air intake port 40*al* provided in the front surface, an air intake port 40*a*2 provided in a right side surface, an air intake port 40*a*3 provided in the rear surface, and an air intake port 40*a*4 provided in a left side surface.

(2-2) Heat Source Heat Exchanger

The heat source heat exchanger 11 is configured to cause heat exchange between a refrigerant and outdoor air. The heat source heat exchanger 11 is a fin-and-tube heat exchanger of a cross-fin type. The heat source heat exchanger 11 includes three heat exchange units 50, a plurality of branching tubes 80, and a U tube 90. The heat source heat exchanger 11 is an exemplary heat exchanger. The heat exchange units 50, the branching tubes 80, and the U tube 90 are made of aluminum or an aluminum alloy, and are joined by brazing.

The heat source heat exchanger 11 is formed into a substantially quadrilateral shape in a planar view so as to follow the side surfaces of the casing 40 (see FIG. 4). However, the heat source unit 2 is not provided, at a front side except a right portion and at a left front side, with the heat exchange units 50 of the heat source heat exchanger 11 that is formed into a substantially quadrilateral shape with an absent portion (a left front portion).

(2-2-1) Heat Exchange Unit

The heat exchange units 50 include a windward heat exchange unit 50*a*, a central heat exchange unit 50*b*, and a leeward heat exchange unit 50*c*. Hereinafter, the windward heat exchange unit 50*a*, the central heat exchange unit 50*b*, and the leeward heat exchange unit 50*c* will also be collectively called the heat exchange units 50.

The heat exchange units 50 are each constituted by a plurality of heat transfer tubes 52 extending horizontally to have a predetermined shape. Specifically, the windward heat exchange unit 50*a* is constituted by a plurality of heat transfer tubes 52*a*, the central heat exchange unit 50*b* is constituted by a plurality of heat transfer tubes 52*b*, and the leeward heat exchange unit 50*c* is constituted by a plurality of heat transfer tubes 52*c*. Hereinafter, the heat transfer tubes 52*a*, 52*b*, and 52*c* will also be collectively called the heat transfer tubes 52.

The heat transfer tubes 52 are each formed into a substantially quadrilateral shape having each side following the side surfaces of the casing 40 in a planar view, and partially absent at the front side except the right portion and at the left front side of the heat source unit 2. The heat transfer tubes 52 of each of the heat exchange units 50 are provided to have a predetermined number along a column direction as a normal direction.

The windward heat exchange unit 50*a*, the central heat exchange unit 50*b*, and the leeward heat exchange unit 50*c* are aligned in a direction of the air flow generated by the heat source fan 15. The direction of the air flow generated by the heat source fan 15 indicates an air flow direction (in a planar view) when the heat exchange units 50 are viewed from above. The heat exchange units 50 are disposed in the order of the windward heat exchange unit 50*a*, the central heat exchange unit 50*b*, and the leeward heat exchange unit 50*c* from a windward side in the direction of the air flow generated by the heat source fan 15. In other words, the windward heat exchange unit 50*a* is disposed outside the central heat exchange unit 50*b* so as to surround the central heat exchange unit 50*b* in a planar view. The central heat exchange unit 50*b* is disposed outside the leeward heat exchange unit 50*c* so as to surround the leeward heat exchange unit 50*c* in a planar view.

In this manner, in each of the heat exchange units 50, the heat transfer tubes 52 are disposed to have multiple columns in the normal direction (column direction), and to have multiple rows (three rows in this case) in an air ventilation direction (row direction).

The heat exchange units 50 are disposed as described above, and the heat source fan 15 thus generates the air flow such that the windward heat exchange unit 50*a* is larger in heat exchange quantity than the central heat exchange unit 50*b* and the central heat exchange unit 50*b* is larger in heat exchange quantity than the leeward heat exchange unit 50*c*.

The heat transfer tubes 52 are supported by a plurality of fins 50*d* to have a predetermined gap therebetween in the normal direction. The fins 50*d* are each provided with a hole (not depicted) to receive the heat transfer tube 52. The plurality of fins 50*d* is aligned to be perpendicular to a horizontal direction and have a predetermined gap therebetween in an extending direction of the heat transfer tubes 52. The heat transfer tubes 52 are inserted to the holes provided in the fins 50*d* to be supported by the fins 50*d*. For effective heat exchange between the refrigerant and outdoor air, the heat transfer tubes 52 are disposed in the normal direction such that center axes of the heat transfer tubes 52 of the heat exchange units 50 are not overlapped with each other when viewed in the horizontal direction. FIG. 4 depicts only part of the plurality of fins 50*d* for convenience.

Each of the heat exchange units 50 has pipes disposed at the right end 50R and the left end 50L so as to allow the incoming refrigerant to flow in the normal direction while meandering in the heat transfer tubes 52. The right end 50R of the heat exchange unit 50 is positioned in a right portion of the front surface of the heat source unit 2 in a planar view. The left end 50L of the heat exchange unit 50 is positioned in a front portion of a left surface of the heat source unit 2 in a planar view. More specifically, the heat transfer tubes 52 have right ends 52R positioned at the right end 50R and provided with a plurality of U tubes 90. The heat transfer tubes 52 have left ends 52L positioned at the left end 50L and provided with a plurality of branching tubes 80.

Each of the U tubes 90 connects a right end 52*b*R of the heat transfer tube 52*b* and a right end 52*c*R of the heat transfer tube 52*c* at a predetermined column with a right end 52*a*R of the heat transfer tube 52*a* at an immediately upper column. During heating operation of the air conditioner 1, the refrigerant flowing out of the right end 52*b*R of the heat transfer tube 52*b* and the right end 52*c*R of the heat transfer tube 52*c* at the predetermined column passes the U tube 90 to flow into the windward heat exchange unit 50*a* at the immediately upper column.

Each of the branching tubes 80 connects a left end 52*a*L of the heat transfer tube 52*a* at a predetermined column with a left end 52*b*L of the heat transfer tube 52*b* and a left end 52*c*L of the heat transfer tube 52*c* at the identical column. The branching tube 80 will be described in detail later.

The heat transfer tubes 52*a* constituting the windward heat exchange unit 50*a* each exemplify a third heat transfer tube. The heat transfer tubes 52*b* constituting the central heat exchange unit 50*b* each exemplify a first heat transfer tube. The heat transfer tubes 52*c* constituting the leeward heat exchange unit 50*c* each exemplify a second heat transfer tube.

(2-2-2) Branching Tube

The branching tube 80 branches the refrigerant flowing out of the heat transfer tube 52*a* of the windward heat exchange unit 50*a* to enter the heat transfer tube 52*b* of the central heat exchange unit 50*b* and the heat transfer tube 52*c* of the leeward heat exchange unit 50*c*. The branching tube 80 has three ends including a first end 80*a*, a second end 80*b*, and a third end 80*c*, and these ends are connected to each other.

Figure 5:
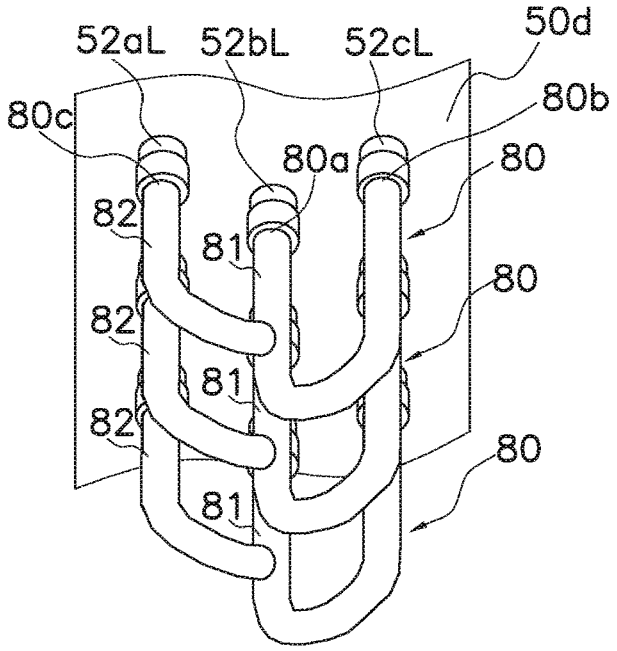
FIG. 5 is a schematic perspective view of a branching tube 80 and the periphery thereof, depicting an attached state to a heat exchange unit 50.
Figure 6:
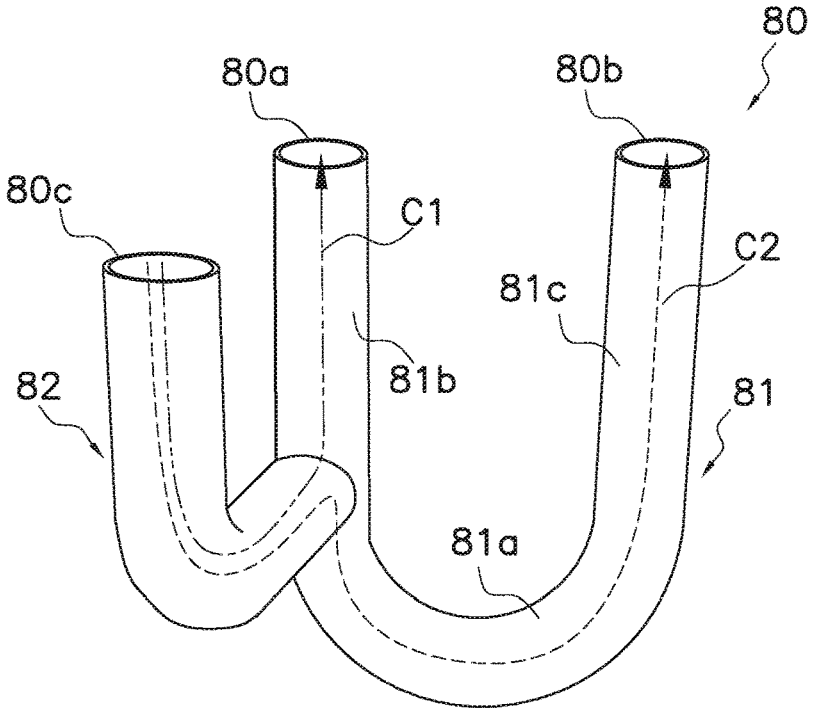
FIG. 6 is a schematic perspective view of a branching tube 80.

FIG. 5 is a schematic perspective view of the branching tubes 80 and the periphery thereof, depicting an attached state to the heat exchange unit 50. FIG. 6 is a schematic perspective view of the branching tube 80.

The branching tube 80 includes a U portion 81 and an inflow portion 82. The U portion 81 and the inflow portion 82 are pipes identical in inner diameter and different in shape.

The U portion 81 divides the refrigerant flowing in from the inflow portion 82 into two flows to enter the heat transfer tube 52*b* and the heat transfer tube 52*c*. The U portion 81 includes a bent portion 81*a*, a first linear portion 81*b*, and a second linear portion 81*c*.

The bent portion 81*a* is bent to have a predetermined radius. The first linear portion 81*b* extends linearly from an end of the bent portion 81*a* to have a predetermined length. The second linear portion 81*c* extends linearly from the other end of the bent portion 81*a* to have a predetermined length. The first end 80*a* is an end far from the bent portion 81*a*, of the first linear portion 81*b*. The second end 80*b* is an end far from the bent portion 81*a*, of the second linear portion 81*c*.

The inflow portion 82 allows the refrigerant flowing out of the heat transfer tube 52*a* of the windward heat exchange unit 50*a* to flow into the U portion 81. The inflow portion 82 has a first end connected to the first linear portion 81*b*. The third end 80*c* is an end far from the first linear portion 81*b*, of the inflow portion 82.

The branching tube 80 has flow paths having flows of the refrigerant and including a first flow path C1 and a second flow path C2. The first flow path C1 connects the first end 80*a* and the third end 80*c*, and includes therebetween the inflow portion 82 and part of the first linear portion 81*b*. The first flow path C1 is depicted by two-dot chain lines in FIG. 6. The second flow path C2 connects the second end 80*b* and the third end 80*c*, and includes therebetween the inflow portion 82, part of the bent portion 81*a*, and the second linear portion 81*c*. The second flow path C2 is depicted by broken lines in FIG. 6. The branching tube 80 is formed such that the first flow path C1 is shorter than the second flow path C2.

The first flow path C1 and the second flow path C2 in the branching tube 80 may be formed to have a length ratio corresponding to a heat exchange quantity ratio between the heat transfer tube 52*b* and the heat transfer tube 52*c* connected to the branching tube 80. For example, the length ratio between the first flow path C1 and the second flow path C2 may be equal to the heat exchange quantity ratio between the heat transfer tube 52*b* and the heat transfer tube 52*c* connected to the branching tube 80.

The branching tube 80 connects the left end 52*a*L of the heat transfer tube 52*a* with the left end 52*b*L of the heat transfer tube 52*b* and a left end 52*c*L of the heat transfer tube 52*c* disposed at the identical column. More specifically, the first end 80*a* of the branching tube 80 is connected to the left end 52*b*L of the heat transfer tube 52*b*. Furthermore, the second end 80*b* of the branching tube 80 is connected to the left end 52*c*L of the heat transfer tube 52*c*. Moreover, the third end 80*c* of the branching tube 80 is connected to the left end 52*a*L of the heat transfer tube 52*a*.

(3) Refrigerant Flow in Heat Source Heat Exchanger

The refrigerant flows as follows in the heat source heat exchanger 11.

When the air conditioner 1 executes heating operation and the heat source heat exchanger 11 functions as a refrigerant evaporator, a refrigerant in the gas-liquid two-phase state flows from the liquid refrigerant tube 20 into the heat transfer tube 52 at the lowermost column. In this case, the heat transfer tube receiving the refrigerant may be either the heat transfer tube 52*b* of the central heat exchange unit 50*b* or the heat transfer tube 52*c* of the leeward heat exchange unit 50*c*. The refrigerant flowing from the left end 52L into the heat transfer tube 52 flows in the heat transfer tube 52 to the right end 52R, then passes the U tube 90, and flows into a right end 52*a*R of the heat transfer tube 52*a* of the windward heat exchange unit 50*a* disposed at the immediately upper column. The refrigerant flowing into the heat transfer tube 52*a* flows to the left end 52*a*L, then passes the third end 80*c*, and flows into the inflow portion 82 of the branching tube 80.

The refrigerant flowing into the branching tube 80 passes the inflow portion 82 and then flows into the U portion 81 to be branched. The refrigerant flowing into the branching tube 80 is thus divided to the refrigerant flowing in the first flow path C1 and the refrigerant flowing in the second flow path C2. Specifically, the refrigerant flowing in the first flow path C1 passes the inflow portion 82, flows into the first linear portion 81*b*, and flows out of the first end 80*a*. The refrigerant flowing out of the first end 80*a* flows into the heat transfer tube 52*b* of the central heat exchange unit 50*b*. The refrigerant flowing in the second flow path C2 passes the inflow portion 82, flows into the bent portion 81*a*, then passes the second linear portion 81*c*, and flows out of the second end 80*b*. The refrigerant flowing out of the second end 80*b* flows into the heat transfer tube 52*c* of the leeward heat exchange unit 50*c*. In other words, the refrigerant flowing from the heat transfer tube 52*a* into the branching tube 80 passes the branching tube 80 and then flows into the heat transfer tubes 52*b* and 52*c* at the identical column with the heat transfer tube 52*a*.

The refrigerant flowing into the heat transfer tubes 52*b* and 52*c* flows toward the right ends 50*b*R and 50*c*R, then passes the U tube 90, and flows into the heat transfer tube 52*a* at the immediate upper column. The refrigerant flowing into the heat transfer tube 52*a* flows in the heat transfer tube 52*a* to the left end 52*a*L, then flows into the branching tube 80 connected to the left end 52*a*L, and flows again into the heat transfer tubes 52*b* and 52*c* at the identical column with the heat transfer tube 52*a*.

As described above, the refrigerant flowing from the liquid refrigerant tube 20 into the heat exchange unit 50 flows upward while meandering in the heat transfer tube 52. The refrigerant then flows out of the heat transfer tube 52*a* at the predetermined column, flows to outside the heat source heat exchanger 11, and flows into the first gas refrigerant tube 19.

(4) Characteristics (4-1)

The heat source heat exchanger 11 according to the present disclosure includes the central heat exchange unit 50*b* (the first heat transfer tube), the leeward heat exchange unit 50*c* (second heat transfer tube), and the branching tube 80. The branching tube 80 has the first end 80*a* connected to an end of the central heat exchange unit 50*b*, the second end 80*b* connected to an end of the leeward heat exchange unit 50*c*, and the third end 80*c*. The branching tube 80 connects the first end 80*a*, the second end 80*b*, and the third end 80*c* to each other. The central heat exchange unit 50*b* is larger in heat exchange quantity than the leeward heat exchange unit 50*c*. The branching tube 80 includes the first flow path C1 connecting the first end 80*a* and the third end 80*c*, and the second flow path C2 connecting the second end 80*b* and the third end 80*c*, and the first flow path C1 is shorter than the second flow path C2.

In the heat source heat exchanger 11, the first flow path C1 is shorter than the second flow path C2. Accordingly, the refrigerant flowing in the first flow path C1 receives a pressure loss smaller than a pressure loss received by the refrigerant flowing in the second flow path C2. The refrigerant flowing into the heat transfer tube 52*b* via the branching tube 80 is thus larger in flow rate than the refrigerant flowing into the heat transfer tube 52*c* via the branching tube 80.

As a result, even when the heat transfer tube 52*b* is larger in heat exchange quantity than the heat transfer tube 52*c*, suppressed is increase in difference between a degree of superheating generated in the heat transfer tube 52*b* and a degree of superheating generated in the heat transfer tube 52*c*. This inhibits deterioration in performance of the heat source heat exchanger 11 due to the difference in degree of superheating between the heat transfer tube 52*b* and the heat transfer tube 52*c*.

The heat source heat exchanger 11 can thus suppress increase in production cost by adopting the branching tube 80 simply structured, as well as achieve improvement in performance.

(4-2)

In the heat source heat exchanger 11, the first flow path C1 and the second flow path C2 in the branching tube 80 may be formed to have a length ratio corresponding to a heat exchange quantity ratio between the heat transfer tube 52*b* and the heat transfer tube 52*c* connected to the branching tube 80.

As described above, in the heat source heat exchanger 11, quantity of the refrigerant flowing out of the first end 80*a* and quantity of the refrigerant flowing out of the second end 80*b* are determined in accordance with the pressure loss received by the refrigerant in the first flow path C1 and the pressure loss received by the refrigerant flowing in the second flow path C2. Accordingly, a ratio between the quantity of the refrigerant flowing into the heat transfer tube 52*b* and the quantity of the refrigerant flowing into the heat transfer tube 52*c* is determined in accordance with the length ratio between the first flow path C1 and the second flow path C2.

Therefore, in an exemplary case where the length ratio between the first flow path C1 and the second flow path C2 is equal to the heat exchange quantity ratio between the heat transfer tube 52*b* and the heat transfer tube 52*c* connected with the branching tube 80, the branching tube 80 can decrease the difference in degree of superheating between the heat transfer tube 52*b* and the heat transfer tube 52*c*, for provision of the heat source heat exchanger 11 exerting higher performance.

(4-3)

In the heat source heat exchanger 11, the branching tube 80 includes the U portion 81, and the inflow portion 82 having an end connected to the U portion 81. The U portion 81 includes the bent portion 81*a*, the first linear portion 81*b*, and the second linear portion 81*c*. The bent portion 81*a* is bent to have the predetermined radius. The first linear portion 81*b* extends linearly from an end of the bent portion 81*a*. The second linear portion 81*c* extends linearly from the other end of the bent portion 81*a*. The first linear portion 81*b* has an end far from the bent portion 81*a*, and the end corresponds to the first end 80*a*. The second linear portion 81*c* has an end far from the bent portion 81*a*, and the end corresponds to the second end 80*b*. The inflow portion 82 has the end connected to the first linear portion 81*b*, and the other end corresponding to the third end 80*c*. The first flow path C1 includes the inflow portion 82 and part of the first linear portion 81*b*. The second flow path C2 includes the inflow portion 82, part of the bent portion 81*a*, and the second linear portion 81*c*.

In the heat source heat exchanger 11, the branching tube 80 is simply structured to include the U portion 81 and the inflow portion 82, and can thus be produced at low cost. The first flow path C1 and the second flow path C2 can be easily adjusted in length by changing a position of attachment of the inflow portion 82 to the U portion 81.

(5) Modification Examples

Description is made hereinafter to modifications to the embodiments described above. Part or entirety of any one of the modification examples may be combined with contents of a different one of the modification examples within a range causing no inconsistency therebetween.

(5-1) Modification Example 1

Figure 7:
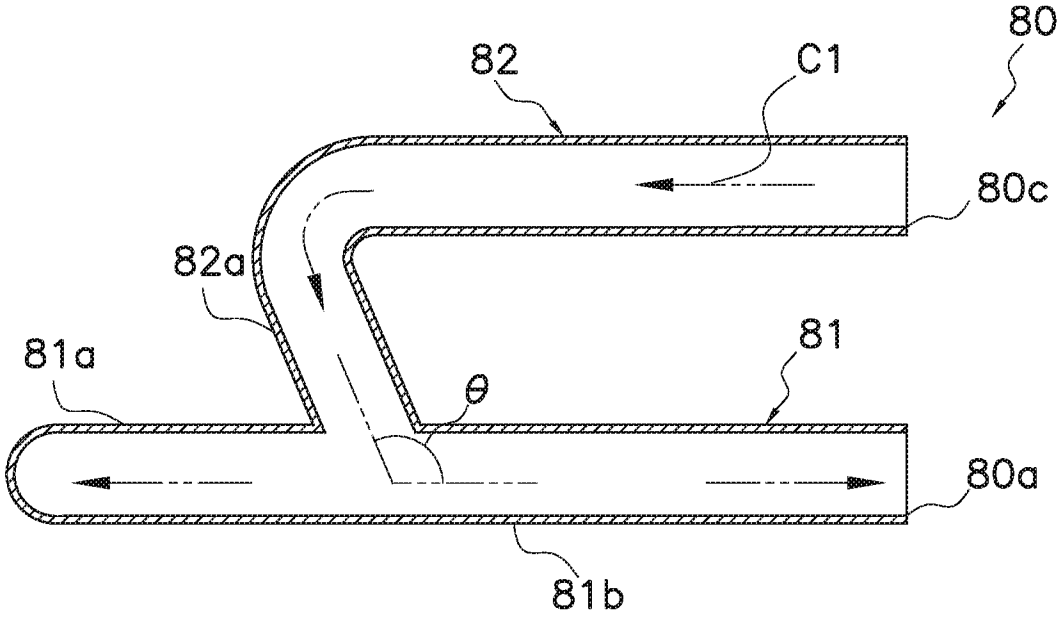
FIG. 7 is a sectional view of the branching tube 80 according to a modification example 1, the branching tube 80 including a third linear portion 82*a*.

The inflow portion 82 may include the third linear portion 82*a* extending linearly from a point connected to the first linear portion 81*b*. FIG. 7 is a sectional view of the branching tube 80 according to the modification example 1, the branching tube 80 including the third linear portion 82*a*. FIG. 7 is a sectional view of the branching tube 80 according to the modification example 1, taken along a plane including the first linear portion 81*b* and the third linear portion 82*a*.

When the branching tube 80 includes the third linear portion 82*a*, in a plain including a center axis of the first linear portion 81*b* and a center axis of the third linear portion 82*a*, among angles formed between the center axis of the third linear portion 82*a* and the center axis of the first linear portion 81*b*, an angle θ adjacent to the first end 80*a* may be 90 degrees or more and 135 degrees or less.

When the angle θ is within the above range, in comparison to a case where the angle θ is less than 90 degrees, the refrigerant passing the first flow path C1 flows more smoothly from the inflow portion 82 into the first linear portion 81*b*. This secures a larger flow rate of the refrigerant flowing into the heat transfer tube 52*b*, to provide the heat source heat exchanger 11 exerting higher performance.

(5-2) Modification Example 2

The above description refers to the heat source heat exchanger 11 having the three rows constituted by the windward heat exchange unit 50*a*, the central heat exchange unit 50*b*, and the leeward heat exchange unit 50*c*. The branching tube 80 may alternatively be applied to a heat exchanger constituted by heat exchange units forming two rows.

(5-3) Modification Example 3

The above description refers to the exemplary case where the third end 80*c* of the branching tube 80 is connected to the heat transfer tube 52 of the heat exchange unit 50. The third end 80*c* may alternatively be connected to a tube other than the heat transfer tube 52.

For example, the third end 80*c* may be connected to the first gas refrigerant tube 19 or the liquid refrigerant tube 20, and the first end 80*a* and the second end 80*b* may be connected to the heat transfer tubes 52 different in heat exchange quantity. The branching tube 80 can thus differentiate in flow rate between the refrigerants flowing into the two heat transfer tubes 52 via the first gas refrigerant tube 19 or the liquid refrigerant tube 20. This can inhibit deterioration in performance of the heat exchange unit 50 due to the difference in heat exchange quantity between the two heat transfer tubes 52.

(5-4) Modification Example 4

The above description refers to the heat source heat exchanger 11 having the difference in heat exchange quantity caused by disposing, on the windward side and the leeward side, the two heat transfer tubes 52 connected with the first end 80*a* and the second end 80*b* of the branching tube 80. However, the difference in heat exchange quantity between the two heat transfer tubes 52 is not limitedly due to this configuration. For example, the branching tube 80 may be applied to a heat exchanger having a difference in heat exchange quantity between the two heat transfer tubes 52 due to a difference in wind speed of air hitting the heat transfer tubes 52.

(5-5) Modification Example 5

The above description exemplifies the case where the branching tube 80 is applied to the heat source heat exchanger 11. The branching tube 80 may alternatively be applied to the utilization heat exchanger 32.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioner
2 heat source unit
3 utilization unit
11 heat source heat exchanger
23 control unit
32 utilization heat exchanger
50 heat exchange unit
50*a* windward heat exchange unit
50*b* central heat exchange unit
50*c* leeward heat exchange unit
52 heat transfer tube
52*a* heat transfer tube (third heat transfer tube)
52*b* heat transfer tube (first heat transfer tube)

52*c* heat transfer tube (second heat transfer tube)
80 branching tube
80*a* first end
80*b* second end
80*c* third end
81 U portion
81*a* bent portion
81*b* first linear portion
81*c* second linear portion
82 inflow portion
82*a* third linear portion
C1 first flow path
C2 second flow path

What is claimed is:

1. A heat exchange system comprising:
a housing;
a fan; and
a heat exchanger comprising:
a first heat transfer tube;
a second heat transfer tube; and
a branching tube comprising:
a U-portion comprising:
a bent portion bent to a predetermined radius and having a first end and a second end;
a first linear portion extending linearly from the first end of the bent portion and having one end connected to the first heat transfer tube; and
a second linear portion extending linearly from the second end of the bent portion and having one end connected to the second heat transfer tube;
an inflow portion having a first end and a second end, wherein the first end is connected to the first linear portion of the U-portion;
a first flow path connecting the second end of the inflow portion with the one end of the first linear portion connected to the first heat transfer tube;
a second flow path connecting the second end of the inflow portion with the one end of the second linear portion connected to the second heat transfer tube, wherein
the first flow path is shorter than the second flow path,
the first flow path is formed by a part of the inflow portion and a part of the first linear portion,
the second flow path is formed by a part of the inflow portion, a part of the bent portion, and a part of the second linear portion, and
the fan and the heat exchanger are located relative to one another in the housing such that the first heat transfer tube is disposed windward of the second heat transfer tube.

2. The heat exchange system according to claim 1, further comprising a third heat transfer tube connected to the second end of the inflow portion.

3. The heat exchange system according to claim 2, wherein the third heat transfer tube is disposed windward of the first heat transfer tube.

4. The heat exchange system according to claim 1, wherein
the inflow portion comprises a third linear portion extending linearly from a point connected to the first linear portion, and
in a plain including a center axis of the first linear portion and a center axis of the third linear portion, among angles formed between the center axis of the third linear portion and the center axis of the first linear portion, an angle adjacent to the one end of the first linear portion is 90 degrees or more and 135 degrees or less.

* * * * *